United States Patent [19]

Gilbreath

[11] Patent Number: 4,620,608

[45] Date of Patent: Nov. 4, 1986

[54] ROLLING SCAFFOLDING BASE

[75] Inventor: William E. Gilbreath, Huffman, Tex.

[73] Assignee: Builders Equipment and Tool Manufacturing Company, Houston, Tex.

[21] Appl. No.: 791,118

[22] Filed: Oct. 24, 1985

[51] Int. Cl.[4] ..... E04G 1/24

[52] U.S. Cl. ..... 182/17; 182/127; 182/178; 280/43.24

[58] Field of Search ..... 182/17, 178, 179, 63, 182/127; 280/43.24, 43.34

[56] References Cited

U.S. PATENT DOCUMENTS

| | | | |
|---|---|---|---|
| 267,578 | 11/1882 | Pallett et al. | 182/17 |
| 2,360,999 | 10/1944 | Wyen | 182/17 |
| 2,398,812 | 4/1946 | Steil | 182/127 |
| 2,798,652 | 7/1957 | Easton | 182/17 |
| 3,156,317 | 11/1964 | Lundeen | 182/17 |
| 3,232,377 | 2/1966 | Smith | 182/17 |
| 3,282,376 | 11/1966 | Merriman | 182/17 |
| 3,391,757 | 7/1968 | Duke et al. | 182/17 |
| 3,463,265 | 8/1969 | Clover | 182/17 |
| 3,817,346 | 6/1974 | Wehmeyer | 182/14 |
| 3,851,728 | 12/1974 | Williams | 182/17 |
| 4,063,616 | 12/1977 | Gutierrez | 182/127 |
| 4,074,789 | 2/1978 | Warren | 182/37 |
| 4,194,591 | 3/1980 | Fisher | 182/17 |
| 4,302,023 | 11/1981 | Kiesz | 280/43.24 |
| 4,397,373 | 8/1983 | Ream et al. | 182/17 |
| 4,427,093 | 2/1984 | Wehmeyer et al. | 182/141 |
| 4,453,619 | 6/1984 | Bierman | 182/150 |
| 4,454,928 | 6/1984 | Marteau | 182/36 |

OTHER PUBLICATIONS

Brochure entitled "Safway Scaffolds Company of Houston", dated 1981, pp. 24–26.

*Primary Examiner*—Reinaldo P. Machado
*Attorney, Agent, or Firm*—Norvell & Associates

[57] ABSTRACT

An improved base is provided for supporting conventional mobile scaffolding commonly used to erect and maintain buildings. The components of the base according to the present invention may be easily stored and transported to the jobsite, and then quickly and reliably assembled in a manner which decreases the likelihood of improper or unsafe assembly. The safety of personnel utilizing such scaffolding is substantially increased by providing a plurality of stop members fixedly secured to the assembled base, with each stop member extending downward and terminating a selected distance above the ground engaging surface of a roller. At least two stop members are provided for each of the base corner rollers, and each stop member is preferably positioned adjacent a line extending between two corner rollers.

20 Claims, 3 Drawing Figures

ROLLING SCAFFOLDING BASE

FIELD OF THE INVENTION

The present invention relates to scaffolding commonly used to erect and maintain building walls and, more particularly, to an improved rolling scaffolding base with increased safety features over prior art rolling bases.

BACKGROUND OF THE INVENTION

Elevated working platforms have long been utilized in the construction and maintenance of building walls. In general, such equipment is either ground supported or suspended from upper portions of the building. An example of a ground supported elevated working platform is described in U.S. Pat. No. 4,427,093, while a ground supported and power operated mobile working platform is disclosed in U.S. Pat. No. 3,817,346. Examples of the suspended version are depicted and described in U.S. Pat. Nos. 4,454,928; 4,453,619; and 4,074,789.

Although various types of equipment have been devised to safely support workers and equipment at the elevated heights required to perform such duties, probably the most commonly used equipment is portable scaffolding. Such scaffolding may be easily and quickly assembled at the jobsite, and may then be disassembled and reassembled at a new location at the jobsite. Sections of scaffold may be added or removed to selectively raise or lower the height of the working platform. Such scaffolding is easily disassembled, transported, and stored by most companies involved in providing elevated working platforms or services connected therewith.

In many installations, the assembled scaffolding is not intended to be moved about at a jobsite. A new construction, for instance, the ground adjacent the building walls may be very uneven, and scaffolding would generally be disassembled and reassembled at a new location at such a jobsite rather than attempting to move the assembled scaffolding as a unit. In other instances, such as those commonly associated with construction jobs wherein the ground adjacent the building is substantially level and perhaps paved or in building maintenance operations, assembled scaffolding is frequently moved as a unit. Such scaffolding is customarily provided with a plurality of rollers for easily moving the assembled scaffolding to the desired location, and is referred to as rolling scaffolding on a rolling tower.

When such rolling scaffolding is moved, personnel and/or heavy equipment are not intended to remain on the scaffolding for safety reasons. Care is therefore exercised in the industry to remind personnel of the dangers associated with moving scaffolding with men and/or equipment on the scaffold. Danger to personnel obviously involves the likelihood of personnel falling from the scaffolding. Also, the scaffolding may tip while being moved since it is "top heavy" with men or equipment. Equipment may fall from a scaffolding as it is being moved, which may injure people on the ground who are manually moving the scaffolding. Also, top heavy scaffolding with such equipment may tip or fall on people, or fall into the building wall, perhaps breaking glass or causing serious bodily injury. Nevertheless, the fact remains that people do not always heed safety instructions, and unfortunately people are injured by improperly moving rolling scaffolding.

Another problem associated with scaffolding and, in particular, rolling scaffolding, is that such equipment may be used although it has been improperly and unsafely assembled. Often, the people using the scaffolding are not the same people who erected the scaffolding. If, based upon a reasonably quick visual inspection, the user does not detect that the scaffolding or scaffolding base is improperly assembled, the scaffolding may be used and the error detected only after a fall and serious injury. Partially because of this reason, scaffolding bases of a substantially one-piece welded construction have been devised. Unfortunately, such a unitary scaffolding base cannot be easily transported between jobsites, and such a unitary base with a damaged component may be used in the field since the component cannot be easily and quickly repaired or replaced.

Many scaffolding bases are little more than four rollers attached to the bottom of conventional scaffolding legs. In field operations, the scaffolding legs tend to become bent when the scaffold is forced against a stationary object, thereby making the rolling tower unsafe. Also, the center of gravity of the rolling tower is rather high, since the legs of the scaffold may fit onto a "base" two feet or more above the ground.

In an effort to improve scaffolding safety, some manufacturers have provided rolling scaffolding bases with scaffolding base outriggers. Outriggers are intended to minimize the likelihood of scaffolding tipping while in use by extending ground supporting members outwardly from the conventional base roller position. Examples of these outriggers are shown in U.S. Pat. Nos. 4,397,373 and 4,427,093. According to the teachings of U.S. Pat. No. 4,194,591, scaffolding outriggers are used in a manner which prevents the rollers or casters from contacting the ground when the scaffolding is in use. Further examples of rolling scaffolding with outriggers are shown on pages 24–26 of a brochure entitled "Safway Scaffolds Company of Houston", dated 1981.

Rolling scaffolding base outriggers may increase scaffolding safety. Nevertheless, scaffolding with such outriggers still may present an unsafe condition, primarily because outriggers are not always properly utilized in field operations. Since outriggers extend outwardly from the base, the base may not be able to be moved as closely adjacent the building wall as the user desires. The user therefore has to elect either to not use that scaffolding, or to utilize that scaffolding by either cutting off the outriggers or otherwise utilizing the outriggers in a manner not intended by the manufacturer. Outriggers which may be moved into position with respect to the base may not be utilized if the user believes, although erroneously, that the outriggers are unnecessary. On the other hand, outriggers rigidly secured to the base may be cut from the base in order to render the scaffolding usable in certain situations. Moreover, outriggers rigidly secured to the base make transportation of the base much more difficult, and for that reason are not favored.

The disadvantages of the prior art are overcome by the present invention, and an improved rolling scaffolding base and mobile tower are hereinafter described.

SUMMARY OF THE INVENTION

A mobile scaffolding base includes a roller member located at each corner of a rectangular-shaped base. A plurality of stop members are each fixedly secured adjacent each roller member, with each stop member terminating a selected distance above the ground engaging surface of the roller. Each stop member is preferably secured to an elongate base side member, and thus lies substantially along a line extending between two rollers.

All base components of the disassembled base may be easily transported and stored, and the base may then be assembled in the field. Adjacent base side members are interconnected by a roller assembly passing through an aperture provided in each side member. Cross braces may be utilized to prevent rotation of one side member relative to an adjacent side member. The scaffolding base is thus assembled in a manner which decreases the likelihood of improper or unsafe assemblage or use of the base.

Accordingly, it is a feature of the invention to provide an improved rolling scaffolding base which increases user safety over conventional roller scaffolding bases.

It is a further of the invention to provide a rolling scaffolding base with stop means positioned substantially within the configuration of the rectangular scaffolding base to prevent the scaffolding on the base from tipping if one of the rollers falls in a hole when the scaffolding is moved.

It is another further of the present invention to provide a safe rolling scaffold which does not utilize outriggers.

Still another further of the invention is to provide a safe rolling scaffolding base which may be easily stored and transported, and then reliably assembled at the desired site.

Yet another feature of the invention is a rolling scaffold base which has a relatively low center of gravity compared to prior art bases.

These and other features and advantages of the present invention will become apparent from the following detailed description of the invention, wherein reference is made to the Figures in the accompanying drawings.

DETAILED DESCRIPTION OF THE INVENTION

Figure 1:
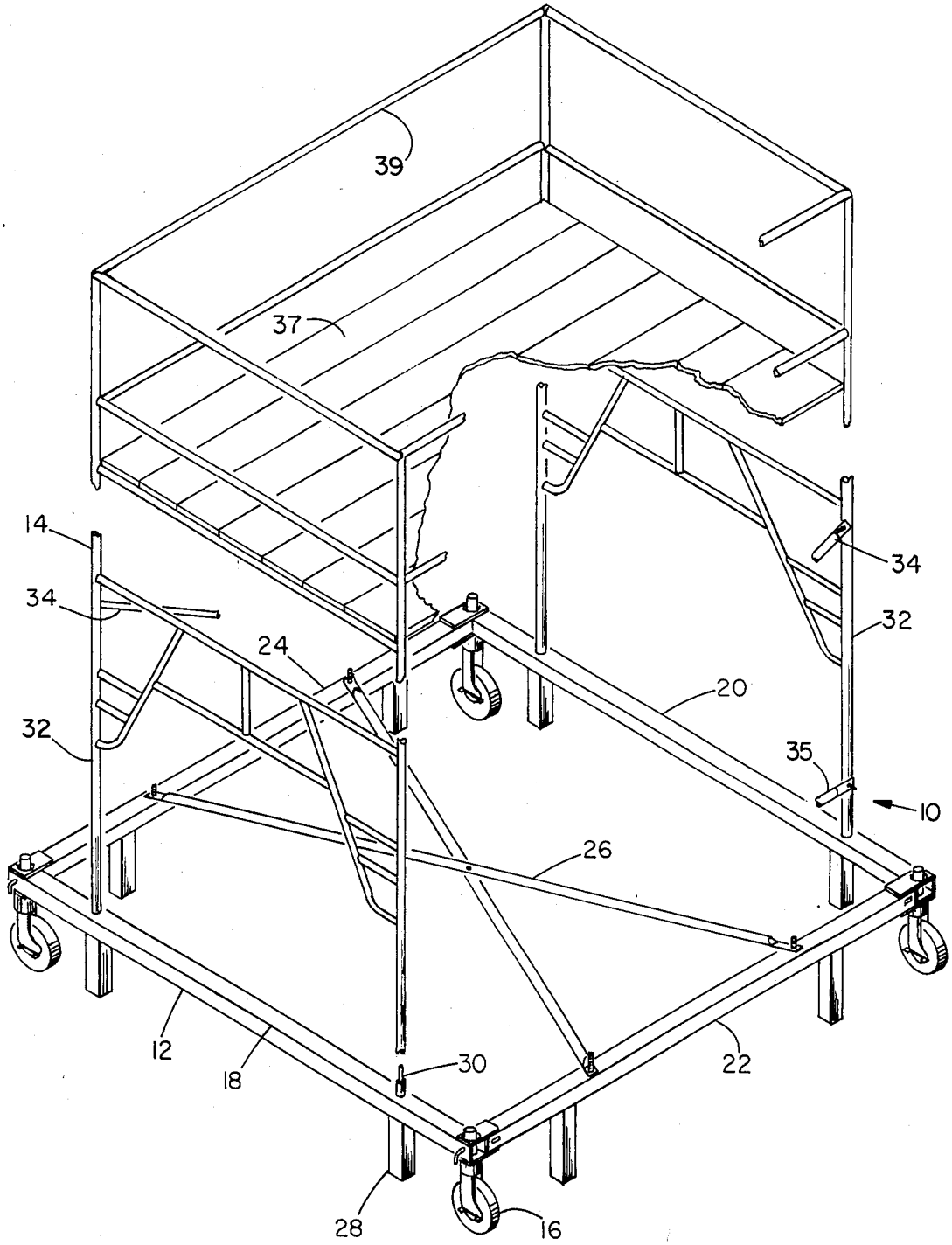
FIG. 1 is a pictorial view of a rolling scaffolding base according to the present invention, with conventional scaffolding in a partial cutaway being shown positioned on the scaffolding base.

FIG. 1 is a pictorial view of a rolling tower 10 according to the present invention, comprising a substantially rectangular base 12 and conventional scaffolding 14 positioned on the base. The tower 10 is typically utilized to position workers at a desired elevation beside a building wall, and the tower 10 is mobile to enable the scaffolding to be easily moved along the wall as desired. Accordingly, a roller assembly 16 is provided adjacent each corner of base 12, with each roller assembly 16 being of the conventional "locking" type for selectively preventing rotation of the roller except when relocation of the tower is desired.

The base 12 comprises first and second identical elongate base side members 18 and 20, and third and fourth identical side members 22 and 24, each subsequently described in detail below. For the present, it should be understood that each elongate member 18, 20, 22, and 24, forms one side of the rectangular-shaped base, and that ends of adjacent base members are interconnected with the roller assembly 16. Rotation of members 22, 24 relative to members 18, 20 is prevented by a pair of cross braces 26 each removably interconnected at one end to member 22 and at the other end to member 24. If desired, the cross-braces 26 may also be pivotably connected at their crossing (coinciding with the center of the base) to provide further strengthening of the base. Substantially the entirety of members 18, 20, 22, and 24 may be formed from conventional 2"×3"×3/16" square tubing, with each member being approximately 7' long. As explained subsequently, the base 12 is thus preferably substantially square-shaped, and members 14, 21, 22, and 24 each lie in and together define a substantially horizontal plane. Members 26 may be fabricated from 1" nominal tubing flattened at each end.

A pair of stop members 28 are provided adjacent each of the roller assemblies, with each stop member being fixedly connected by welding to the bottom surface of one of the elongate members, and extending downwardly to terminate a selected distance above the ground. Each stop member preferably does not extend substantialy outwardly beyond the rectangular configuration of the base, and lies along a straight line between two roller assemblies. In the event that one or more of the members 16 were to drop into a hole (such as that commonly found in parking lots, slab floors, and similar areas adjacent buildings) as the tower 10 is moved, the stop member 28 would engage the ground and thus prohibit the tower from falling. One stop member is preferably provided along each of the base side members joined by the respective roller assembly, so that in the event the hole were to be elongate (somewhat in the form of a trench) or were to be a drop-off (such as a sidewalk step), the scaffolding would still not fall since, regardless of the direction of moving the scaffolding, the other stop member would engage the ground and prohibit the scaffolding from tipping. Each stop member 28 is thus perpendicularly affixed to its respective base member a selected distance from the axis of the roller assembly, and this spacing is in the range of from 6" to 18" and preferably from 9" to 15". It has been found that this spacing insures that the momentum of the tower will not cause the stop member to fall into the hole along with the roller assembly 16, yet this spacing also provides sufficient support spaced from the center of the base to insure that the tower will not fall. For ease of construction, each of the stop members 28 may similarly be fabricated from 2"×3" square tubing.

Scaffolding 14 is supported on the base 12 by four upwardly extending members 30 commonly referred to as "bullnoses", each affixed to the top surface of opposing base side members 18, 20. Scaffolding 14 includes a plurality of end frame members 32, a plurality of cross braces 34, and a plurality of horizontal braces 35. Toward the upper portion of the scaffold, a working platform 37 may typically be provided, along with suitable guardrails 39 as shown.

End frames 32 may be fabricated by welded construction from tubular material, and each typically lies in a single plane. An end frame may be from 6' to 8' high, and approximately 5' wide. Accordingly, bullnose members 30 on both base members 18 and 20 may be spaced 5' apart for receiving the lower ends of the end frames. Cross members 34 and horizontal braces 35 are each removably secured to the end frames as shown, and provide the relatively rigid construction necessary for scaffolding. It should be understood that the height of the scaffolding may be easily changed by adding or deleting end members and associated cross braces and bracing members, as more fully shown on the referenced pages of the "Safway Scaffolds Company Of Houston" brochure. Since the elongate cross braces and horizontal braces are easily removed from the end frames, it should be understood that the scaffolding shown in FIG. 1 may be easily "broken down" for transportation and storage.

In the embodiment shown in FIG. 1, scaffolding is approximately 5′ by 7′ in horizontal cross-section, and rectangular-shaped scaffolding is typically used in the industry. The rolling base according to the present invention is preferably square-shaped, with each of the sides approximating the longer side of the rectangular-shaped scaffolding. Accordingly, base 12 shown in FIG. 1 is approximately 7′×7′, and if scaffolding having a base cross-section of 6′×8′ were utilized, the base would preferably be 8′×8′. Safety standards for scaffolding limit the height of the scaffolding to a fixed multiple of the minimum base width; typically the height is 4 times the minimum base width. Accordingly, scaffolding as shown in FIG. 1 may be safely utilized to a height of 28′. A particular advantage of the tower as shown in FIG. 1 is that a relatively high scaffolding may be mounted on the base, yet the base does not utilize outriggers which may cause unsafe conditions mentioned earlier. Thus, it is a particular feature of the present invention to provide a square-shaped base for supporting a rectangular-shaped scaffolding, with the scaffolding and base centers being aligned, and the scaffolding being supported on the two base side members directly beneath the shorter sides of the rectangular-shaped scaffolding.

Figure 2:
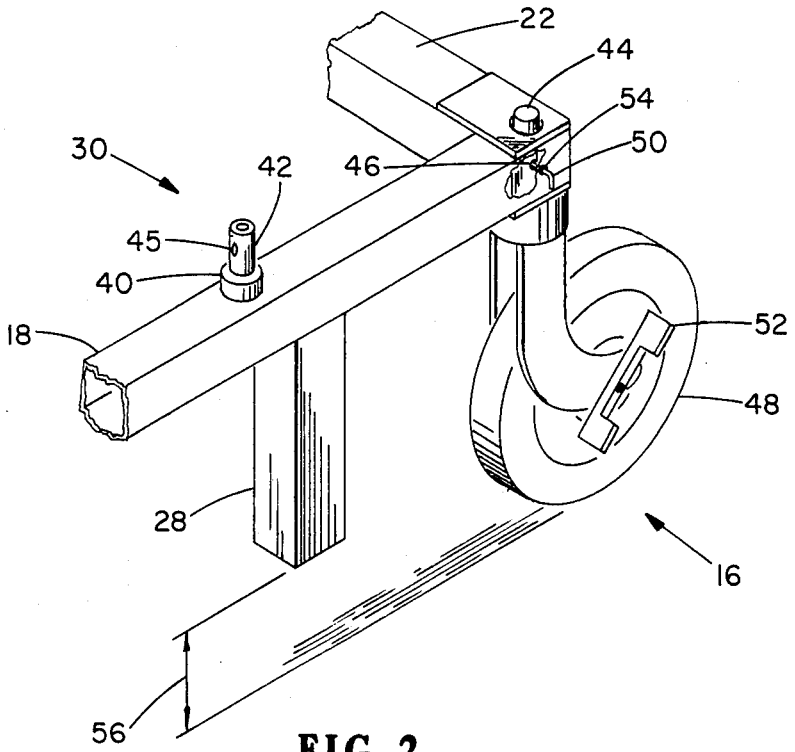
FIG. 2 is a pictorial view of a corner of a typical assembled scaffolding base according to the present invention.

Referring now to FIG. 2, a pictorial view of a typical corner of the scaffolding and base is depicted. Bullnose 30 is shown in detail, comprising an outer sleeve 40 welded to the top surface of the rectangular tubing 18. Pipe section 42 is positioned within the ID of sleeve 40, and may be secured to the sleeve by spot welding or plug welding. The lower tubular ends of end frame 32 thus abut against the top surface of sleeve 40, and are supported by the relatively close tolerance between the ID of the tubular members of end frames 32 and the OD of pipe 42. Bullnose 40 may typically project upwards from the top surface of tube 18 approximately 5″, and an aperture 45 may be provided in pipe 42 for receiving a pin member for securing the end frame to the bullnose.

As suggested earlier, the centerline distance between roller assemblies 16 may be 7′, while the scaffolding width is 5′. Thus, bullnose 30 may be positioned 1′ from the roller assembly. Also typically positioned approximately 1′ from the roller assembly 16 is stop member 28, which is welded to the bottom surface of the tubular member 18. Assembly 16 includes an upwardly extending 1½″ diameter rod 44, an aperture 46 for receiving pin 50 also extending through aperture 54 in base side member 18. FIG. 2 also generally depicts locking mechanism 52 for temporarily prohibiting rotation of the roller 48. Such locking mechanisms and rollers are well known in the industry, an example being the Model C8R caster available from Safway Scaffolds Company of Houston.

Roller assembly 16 includes roller 48, and the bottom stop surface of member 28 is a selected distance 56 above the ground-engaging surface of the roller assembly. According to the present invention, this distance 56 may be within the range of from ½″ to 2″, and preferably within the range of from ¾″ to 1½″, and an appropriately positioned aperture 46 is accordingly provided in rod 44. The spacing between the ground-engaging surface of the roller assembly and aperture 46 thus determines the length of member 28 extending downward from the bottom surface of member 18. An advantage of selecting a spacing 56 of less than 1½″ relates to the increased assurance that the rolling tower will not tip over if assembly 16 falls in a hole. The bottom surface of each member 28 thus terminates at a position substantially below the horizontal plane containing the members 18, 20, 22, and 24. This bottom surface is designed to engage the ground and prevent the scaffolding from tipping should an adjacent roller assembly drop off a substantially horizontal surface (e.g., into a hole).

Figure 3:
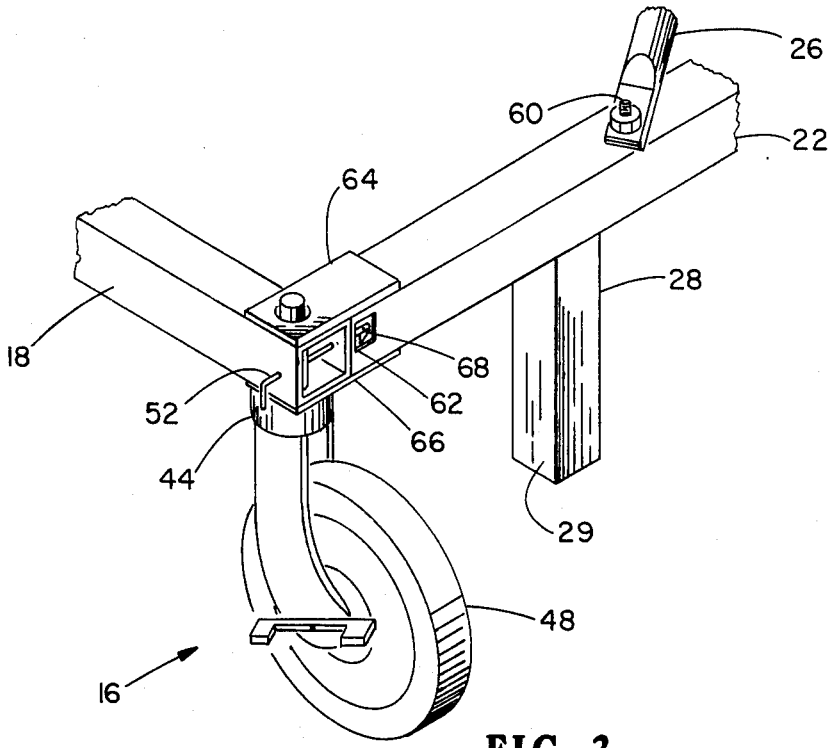
FIG. 3 is another pictorial view of the scaffolding base corner shown in FIG. 2.

FIG. 3 is another pictorial view of the apparatus shown in FIG. 2, more clearly depicting the assembly 16 relative to the side member 22. Member 22 is shown to include plates 64 and 66, each respectively welded to the upper and lower surface of member 22 and extending from the end of the rectangular member 22. 1½″ diameter slightly oversized holes may be provided in each of the plates 64 and 66, and similarly sized holes are provided adjacent the ends of the tubular member 18 through the upper and lower tube sidewalls. Accordingly, rectangular tube 18 fits easily between the bottom of plate 64 and the top of plate 66, thereby providing very limited upward or downward movement of member 18 relative to member 22. Rod 44 may thus be inserted through these four aligned apertures to interconnect members 18 and 22. Pin 52 is shown with a commonly used dog member end 68 for preventing the pin from inadvertently falling out of aperture 46. An aperture 62 is provided in either or both sides of member 22, allowing the user to insert a finger or suitable tool to disengage the dog, thereby enabling the removal of pin 52 as desired.

FIG. 3 illustrates that, with pin 52 in place, member 18 is substantially fixed relative to rod 44. Depending on the tolerance between the end of the rectangular member 22 and the inner sidewall of member 18, member 22 may be slightly rotatable relative to rod 44. Any substantial rotation is prevented from occurring, however, by providing cross members 26 as shown in FIG. 1. Threaded stud 60 is welded to the top surface of member 22, and each flattened end of cross member 26 contains an aperture for receiving stud 60. A suitable nut or other securing means may thus be utilized to fix the end of cross member 26 relative to member 22. A preferred cross-member securing means is shown in copending U.S. Ser. No. 657,979, hereby incorporated by reference.

It should be understood that the apparatus shown in FIG. 1 may be easily assembled and disassembled. In particular, the four elongate base side members 18, 20, 22, and 24 may be easily stored and transported to the jobsite along with elongate cross members 26 and four roller assemblies 16. Once at the jobsite, the apertures is in the ends of members 18 and 22 may be aligned with the apertures in plates 64 and 66, and the roller assembly inserted to interconnect members 18 and 26. Similarly, each corner of the generally rectangular base may be assembled in a manner which substantially decreases the likelihood of misassembly. Pin 52 provided for each of the roller assemblies locks the members 18 and 22 into position with respect to the roller assembly, and installation of cross members 26 effectively forms a relatively rigid base. Once the properly sized roller assemblies 16 are assembled, each stop member 28 may thus be positioned within a selected range above the ground. Thereafter, the scaffolding may be assembled on the base in a conventional fashion.

Each of the four wheel assemblies 16 thus serves to both support the base and also to interconnect adjacent base side members. The safety of the apparatus is substantially improved since few components are required, and those components critical to the safety of the base are also essential to practical utilization of the base. In particular, the user does not make any determination of whether or not to utilize the stop members 28, and no adjustment of these stop members is required, since the stop members 28 are permanently affixed to the respective base side member.

Each corner of the base is thus supported by a bearing pad of a respective roller assembly. The weight of the scaffolding rests on these bearing pads and not on pins 52. These pins serve to prevent a roller assembly from unintentionally disengaging from the interconnected components, e.g., 18 and 22. In some cases, a rolling tower may begin to tip, but then right itself. If pins 52 are not utilized, the two roller assemblies which tip out of engagement with the ground will slip off of the base, in which case the tower will then fall in the opposite direction. According to the present invention, the roller assemblies would not disengage from the base because of pins 52. Even if these pins 52 are not utilized, however, substantial opposite-direction tipping would be prevented by the downward extending legs 28 adjacent the roller assemblies that may disengage from the base.

It should also be understood that any one of the four bottom edges of a member 28 may engage the ground when an adjacent roller assembly falls in a hole, depending on the direction of travel of the roller assembly relative to the hole (or drop-off). It is a particular feature of the invention that the bottom surface of member 28 be substantially parallel to the ground, and have a perimeter of at least several inches. Regardless of the direction of travel, an edge of leg 28 facing the direction of travel as the assembly drops in the hole will tend to dig into the concrete or asphalt surface. This leading edge will therefore "bite" into the ground, and substantially minimize the likelihood that the adjacent leg will also not fall into the hole. Depending on the direction of travel, this biting action on the leading edge of member 28 may not occur if the bottom surface of 28 were, for example, either angled in the horizontal plane or arcuate-shaped in any vertical plane.

When in use, it should be understood that any of the base sides may be positioned adjacent the building wall. If the user desires to maintain close tolerance between the scaffolding and the wall, members 18 or 20 may be positioned against the building wall. In most cases, however, a distance between the scaffolding platform and the wall of 1′ or more may be desired, so that side 22 or 28 may be positioned adjacent the building wall. In either event, outriggers are not required and thus do not interfere with the operation or utilization of the base. Nevertheless, it is possible to utilize conventional outriggers with the base of the present invention.

A particular advantage of the present invention over prior art rolling scaffolding relates to a relatively low center of gravity of the scaffolding constructed on the base. The height of the rectangular tubing, generally between 2″ and 4″, is the only spacing between the supporting surface of the roller assemblies and the bottom legs of the scaffolding. The center of the rolling tower is substantially lower than, for example, the towers shown in pages 22–24 of the previously referenced publication. Moreover, components of the frame are interconnected in a simplistic manner, which reduces the likelihood of assembly error. The materials of the base are substantially rigid, and the base cannot therefore be bent or otherwise damaged during normal use. If desired, additional weight may be added to the base to further lower the center of gravity of the tower. For example, a member passing through the center of the base (below the cross braces 26) may be removably secured between tubing lengths 18 and 20. Weights may then be supported on this member, with the weights preferably positioned adjacent the center of the base to further reduce the likelihood of tipping.

It should be understood that various modifications of the present invention may be made without departing from the spirit of the present invention. More than two spaced-apart stop members may be utilized adjacent each roller assembly, and one or more stop members may be secured to a respective base side member so that such a stop member is slightly interior or slightly exterior to the generally rectangular configuration of the assembled base. The base may be provided with bumper members extending outwardly slightly from the rectangular-shaped frame, which will further minimize the likelihood of damage if the base is forced against another object. These and other modifications will be readily apparent to those skilled in the art, and the drawings and detailed description herein provided should thus be understood as merely exemplary of the present invention.

What is claimed is:

1. A rolling scaffolding base having a generally rectangular configuration and a plurality of roller assemblies, each of said roller assemblies having a roller member with a rolling ground-engaging surface and an upward extending shaft, each of said roller assemblies being positioned adjacent a corner of said rectangular configuration, the improvement comprising:

first, second, third, and fourth structurally separable elongate base side members each lying in a substantially horizontal plane and forming one side of said rectangular configuration;

each of said base side members including a roller shaft receiving aperture adjacent each end of said elongate member;

adjacent ends of said side members being removably interconnected by a respective one of said roller shafts;

two or more stop members adjacent each of said roller assemblies and having a stop surface terminating a selected distance above said ground engaging surface at a position substantially below said horizontal plane; and one of said two or more stop members being fixedly secured to one of said elongate base side members and another of said two or more stop members being fixedly secured to another of said elongate base side members.

2. The apparatus as defined in claim 1,. wherein substantially the entire length of each of said elongate base side members is formed from tubing having a rectangular-shaped cross-section, and two of said elongate base side members include upper and lower plates adjacent the ends of said elongate base side members and spaced apart for receiving an end of an adjacent side member.

3. The apparatus as defined in claim 1, further comprising:

at least one cross brace interconnected between one of said elongate base side members and an opposing elongate base side member for maintaining said assembled base in a rectangular configuration.

4. The apparatus as defined in claim 1, further comprising:

means for removably affixing the axial position of each of said roller shafts relative to said elongate base side members.

5. The apparatus as defined in claim 1, wherein each of said stop members does not extend outwardly substantially beyond the rectangular configuration of said assembled base.

6. The apparatus as defined in claim 5, wherein each of said stop members lies substantially along a straight line between two of said roller assemblies.

7. The apparatus as defined in claim 1, further comprising:

at least four scaffolding supports each affixed to a top surface of opposing elongate base side members at a position substantially removed from a corner of said rectangular configuration; and said first, second, third, and fourth elongate base side members form a substantially square base.

8. The apparatus as defined in claim 4, wherein each of said stop members terminates a selected distance of from ½" to 1½" above said ground-engaging surface.

9. The apparatus as defined in claim 7, wherein the lower surface of each of said stop members lies in a substantially horizontal plane thereby forming an edge for biting engagement with said ground.

10. The apparatus as defined in claim 1, wherein each of said stop members is fixedly positioned from between 6" to 18" from said shaft receiving aperture for receiving one of said roller shafts.

11. A rolling scaffolding base having a generally rectangular configuration and a plurality of roller assemblies, each of said roller assemblies having a ground-engaging surface and being positioned adjacent a corner of said rectangular configuration, the improvement comprising:

first, second, third, and fourth elongate base side members each forming one side of said rectangular configuration;

two or more stop members adjacent each of said roller assemblies and each lying substantially along a straight line between two of said roller assemblies;

each of said stop members extending downwardly from an adjacent elongate base side member and having a stop surface terminating a selected distance above said ground engaging surface; and one of said two or more stop members being fixedly secured to one of said elongate base side members and another of said two or more stop members being fixedly secured to another of said elongate base side members.

12. The apparatus as defined in claim 11, wherein substantially the entire length of each of said elongate base side members is formed from tubing having a rectangular-shaped cross-section, and two of said elongate base side members include upper and lower plates adjacent the ends of said elongate base side members and spaced apart for receiving an end of an adjacent side member.

13. The apparatus as defined in claim 12, wherein each of said stop members terminates a selected distance of from ½" to 1½" above said ground-engaging surface.

14. The apparatus as defined in claim 11, further comprising:

each of said roller assemblies including a roller member and an upwardly extending shaft;

each of said base side members including a roller shaft receiving aperture adjacent each end of said elongate member; and adjacent ends of said side members being removably interconnected by a respective one of said roller shafts.

15. The apparatus of claim 11, further comprising:

at least four scaffolding supports each affixed to a top surface of opposing elongate base side members at a position substantially removed from any corner of said rectangular configuration; and said first, second, third, and fourth elongate base members form a substantially square base.

16. A rolling scaffolding base having a generally rectangular configuration comprising:

a plurality of roller assemblies each having a rolling ground-engaging surface and being positioned adjacent the corner of said rectangular configuration;

first, second, third, and fourth structurally separable elongate base side members each forming one side of said rectangular configuration and lying in a substantially horizontal plane;

each of said base side members including a roller shaft receiving aperture adjacent each end of said elongate member;

adjacent ends of said side members being removably interconnected by said roller shaft;

at least one cross brace interconnected between one of said elongate base side members and an opposing elongate base side member for maintaining said assembled base in a rectangular configuration; and two or more stop members adjacent each of said roller assemblies and having a stop surface terminating a selected distance above said ground engaging surface at a position substantially below said horizontal plane.

17. The apparatus as defined in claim 16, wherein substantially the entire length of each of said elongate base side members is formed from tubing having a rectangular-shaped cross-section, and two of said elongate base side members include upper and lower plates adjacent the ends of said elongate base side members and spaced apart for receiving an end of an adjacent side member.

18. The apparatus as defined in claim 16, further comprising:

one of said two or more stop members being fixedly secured to one of said elongate base side members and another of said two or more stop members being fixedly secured to another of said elongate base side members; and each of said stop members does not extend outwardly substantially beyond the rectangular configuration of said assembled base.

19. The apparatus as defined in claim 16, further comprising:

each of said roller assemblies including a roller member and an upwardly extending shaft; and means for removably affixing the axial position of each of said roller shafts relative to said elongate base side members.

20. The apparatus as defined in claim 16, further comprising:

a plurality of scaffolding supports affixed to a top surface of two of said elongate base side members; and said first, second, third, and fourth elongate base members form a substantially square base.

* * * * *